United States Patent [19]

Schweiss et al.

[11] Patent Number: 5,056,262

[45] **Date of Patent: * Oct. 15, 1991**

[54] RELEASABLE WINDOW GUARD ASSEMBLY

[75] Inventors: Kenneth K. Schweiss, Wyoming; Charles D. Flack, Jr.; Harold E. Flack, II, both of Dallas, all of Pa.; Lawrence P. Simms, New York, N.Y.

[73] Assignee: Exeter Architectural Products, Inc., Wyoming, Pa.

[ * ] Notice: The portion of the term of this patent subsequent to Feb. 19, 2008 has been disclaimed.

[21] Appl. No.: 610,073

[22] Filed: Nov. 7, 1990

Related U.S. Application Data

[63] Continuation-in-part of Ser. No. 421,344, Oct. 19, 1989, Pat. No. 4,993,187.

[51] Int. Cl.[5] ..... E06B 3/68

[52] U.S. Cl. ..... 49/56; 49/55; 49/67; 49/257

[58] Field of Search ..... 49/13, 14; 340/426

[56] References Cited

U.S. PATENT DOCUMENTS

| | | | |
|---|---|---|---|
| 1,192,406 | 7/1916 | Fair | 49/67 X |
| 1,278,502 | 9/1918 | Plummer | 49/254 X |
| 3,788,689 | 1/1974 | Lloyd | 49/254 X |
| 3,832,805 | 9/1974 | Stevens | 49/56 X |
| 3,973,357 | 8/1976 | Kluempers | 49/13 |
| 4,035,791 | 7/1977 | Katayama | 340/426 X |
| 4,041,450 | 8/1977 | Knight | 340/426 X |
| 4,284,980 | 8/1981 | Hoinski | 49/13 X |
| 4,294,040 | 10/1981 | Crotti | 49/254 |
| 4,304,428 | 5/1983 | Cox | 49/57 X |
| 4,346,372 | 8/1982 | Sandberg | 49/14 X |
| 4,593,492 | 6/1986 | Lumenello | 49/55 X |
| 4,624,072 | 11/1986 | Zilkha | 49/55 |
| 4,630,396 | 12/1986 | Zvi et al. | 49/55 |
| 4,640,109 | 2/1987 | Schaublin et al. | 70/DIG. 49 |
| 4,663,611 | 5/1987 | Humphrey | 70/DIG. 49 |
| 4,679,353 | 7/1987 | Langenbach et al. | 49/254 X |
| 4,686,792 | 8/1987 | Terrian | 49/13 |
| 4,791,762 | 12/1988 | Hwang | 49/449 X |
| 4,841,277 | 6/1989 | Wilson | 340/426 |
| 4,937,556 | 6/1990 | Scott et al. | 49/14 X |

*Primary Examiner*—Rodney M. Lindsey
*Assistant Examiner*—Jerry Redman
*Attorney, Agent, or Firm*—Michael Ebert

[57] ABSTRACT

A window guard screen and frame assembly installable on the jamb of a building window to prevent unauthorized access thereto. The screen is fabricated of a metal sheet whose margins are folded in to define channel-like end and side branches bordering a planar field perforated to admit light and air. The frame is dimensioned to overlie or nest within the window jamb and is secured thereto. Integral with the inner surface of the frame and bordering the opening therein is a slideway socket for receiving the screen, the socket being defined by end and side legs which complement the branches of the screen. Hinge pins are mounted on the end legs of the slideway socket adjacent one side leg, the pins extending through elongated slots formed in the corresponding end branches of the screen whereby the screen is slidable to an extent limited by the slots from a security mode position in which the screen is confined to the socket and the window is guarded, to an access mode position in which the screen is free to swing on the hinge pins out from the frame opening to permit one to exit through the then unguarded window. A releasable latch is mounted on the other side leg of the socket to engage the corresponding side branch of the screen to lock the socketed screen in its security mode position. When released, the latch permits the screen, which is spring loaded, to slide to its access mode position.

10 Claims, 4 Drawing Sheets

W
14
13
16
11
Bd
Ld
22
22P
17
18
10
T
HS
Lb
20
21
Bc
Fe
Lc
15
Fc
23
23P
Fd

RELEASABLE WINDOW GUARD ASSEMBLY

RELATED APPLICATION

This application is a continuation-in-part of our parent application Ser. No. 421,344, of the same title, filed Oct. 19, 1989, now U.S. Pat. No. 4,993,187 the entire disclosure of which is incorporated herein by reference.

BACKGROUND OF INVENTION

1. Field of Invention

This invention relates generally to window guards or security screens to prevent unauthorized access to a building through its windows, and more particularly to a releasable window guard screen and frame assembly whose hinged screen is fabricated from a single sheet of metal and may be swung out of the frame opening to permit exit from the building through the window.

2. Status of Prior Art

It is common practice to protect the windows of a building, especially those on the ground floor level, from unauthorized entry by means of window guards or grills. Commonly used for this purpose is a guard formed by a framed mesh screen of heavy gauge wire, making it difficult for an intruder to cut the mesh. A wire mesh screen or one made of expanded metal not only prevents intruders from gaining access to the building through the guarded windows, but also serves to shield these windows against breakage.

A permanently-installed window guard has a number of disadvantages, the primary drawback being that in the event of a fire or other emergency, it is not possible to leave the building through the guarded window. One must therefore find another way to escape, and this may not then be available. Another disadvantage of a framed wire mesh screen is that, in time, the screen may become loose or detached from its frame and hence cease to be effective.

Another factor that must be taken into account in window guard design is the extent to which the screen cuts down the amount of light and ventilating air admitted therethrough, as well as the degree to which it reduces visibility. With heavy gauge and relatively thick wire mesh screens, there is a marked reduction in the amount of admitted light and air, and visibility is hindered by the thickness of the screen, particularly when looking through the mesh-guarded window at an oblique angle.

Quite apart from these practical limitations is the fact that wire mesh screen or expanded metal window guards are unappealing from the aesthetic standpoint, for a building having such purely utilitarian window guards presents a prison or factory-like appearance. Conventional security screens for jails and mental institutions are designed to keep individuals in, not out, with little concern for aesthetics. However an otherwise architecturally attractive school building which is a source of pride to the community may be rendered far less presentable should wire mesh or other conventional forms of security screens be installed to guard the windows.

It is also common practice to provide window guards with releasable locking mechanisms which when unlatched permit the screen to be removed or to swing out, thereby permitting exist through the window in case of fire or other emergency.

The ideal locking mechanism for a window guard is one which can be quickly unlatched without difficulty in the event of an emergency, but which when latched makes it very difficult to remove or to swing out the screen, and therefore affords a high degree of security. Prior art locking mechanisms for window guards are either relatively complicated and difficult to release quickly, or of a simple mechanical design that does not offer a high degree of security.

One must also give consideration in window guard design to the need for repair and maintenance, for in time it may be necessary to replace the screen, to paint it or to lubricate the moving parts. With complicated window guards of the prior art type, these parts may be inaccessible or difficult to remove for purposes of maintenance and repair. Window guards are subjected to weathering, and conventional guards whose hinges and other key components are exposed may, as a result of rusting or painting, become difficult to open.

Yet another factor that comes into play when the window guard is of the type in which a screen is supported by a frame attached to the window jamb is that should there exist even a small gap between the screen and the frame, this makes it possible for an intruder to insert a tool in this gap to pry open the screen.

The Pellicore U.S. Pat. No. 2,924,862 shows a window guard for school houses and other applications in which the guard fits within the window jamb. The window guard comprises a welded steel frame formed of a channel member which supports a woven wire mesh. Also provided is a releasable locking means so that the window guard can be opened quickly in the event of an emergency.

The Levin U.S. Pat. No. 2,711,565 shows a window guard in the form of a main frame secured to the window opening, to which is hinged a closure frame supporting a wire mesh, locking means being provided. Kelly, U.S. Pat. No. 3,087,750, shows a window guard in which a framed woven-wire mesh screen is hinged to the side of a window, a lock being provided. These prior art mesh screen arrangements suffer from many of the drawbacks previously discussed.

The Fernandez U.S. Pat. No. 4,634,157 shows a window guard in which bars are supported by a rectangular frame to provide a guard which presents a prison-like appearance. Also prison-like is the bar assembly shown in U.S. Pat. No. 4,771,574 to Stephens, in which a grid formed by bars is held within a frame. Even more prison-like are the window grill of Warwick, U.S. Pat. No. 4,796,384 and the window guard of Hicks et al., U.S. Pat. No. 4,685,316. The patent to Merry, U.S. Pat. No. 4,677,789, shows a window guard in which a frame is secured to a window opening to which is hinged an inner frame having a grate attached thereto.

Also of background interest are the Crotti patent, U.S. Pat. No. 4,294,040, which shows a safety door for buildings formed by two sliding parts, and the Cox patent, U.S. Pat. No. 4,384,428, which discloses a fire escape gate in which a grill or lattice is secured to a hinged frame.

The Hatvany patent U.S. Pat. No. 4,566,222 discloses a one-piece window guard formed of a sheet of metal or plastic having cutouts therein to provide light and ventilation. The side margins of the sheet are rolled to form cylindrical rims, one receiving a hinge bolt and the other a locking bolt. The hinging rim and the locking rim are attached by angle irons to window wall studs.

Hatvany points out that window guards provided with locking mechanisms which can be released from the inside of a building often include springs, flexible cables and other parts which, once installed, are inaccessible for inspection, cleaning, lubrication or replacement, and that should these mechanisms jam in an emergency situation, the consequences may be serious. Hatvany therefore provides a less complicated release mechanism for his window guard.

However, the Hatvany arrangement must be custom tailored to a window jamb of given dimensions in a complicated, costly, through-wall installation, and cannot be fitted into a jamb whose dimensions differ somewhat from the jamb for which it is designed.

None of the prior art window guards satisfies all of the practical and aesthetic requirements mentioned previously which must be taken into account in the design of a window guard that can, without modification, be fitted into window jambs that vary somewhat in their dimensions.

SUMMARY OF INVENTION

In view of the foregoing, the main object of the invention is to provide an easily-releasable window guard screen and frame assembly installable on the jamb of a building window to prevent unauthorized access to the building through the window, the same assembly being installable in window jambs whose dimensions differ somewhat from window-to-window.

More particularly, an object of this invention is to provide a window guard screen and frame assembly whose screen is fabricated from a single sheet of relatively thin metal perforated in a predetermined pattern to admit light and ventilating air, the pattern being aesthetically pleasing to render the installation attractive.

A significant advantage of an assembly in accordance with the invention is that the assembly constitutes an architectural product that blends in with the architecture of the building in which it is installed, so that the guard function carried out by the assembly is not at the expense of aesthetic considerations.

Also an object of the invention is to provide a window guard assembly whose screen is hingedly-supported on a frame attachable by adjustable brackets to the wall of a window jamb, the brackets making it possible to mount the frame on jambs that from window-to-window vary somewhat in their dimensions, whereby the same assembly may be installed in all windows in the building without the need to custom fit the assembly.

A significant feature of the invention is that no significant gap exists between the single piece screen and the planar frame on which it is supported, thereby obviating the danger of the screen being pried open by a tool inserted in a gap. Another advantage of the invention is that the screen can easily be detached from the frame for purposes of maintenance or repair.

Also an object of the invention is to provide an assembly of the above type having a single releasable latch to permit the screen, which is spring loaded, to shift to a position at which it can be swung out of the frame, which latch is accessible only from the interior of the building.

Another salient feature of the invention resides in its safety, for the quick-release latch on the unit expedites fast and sure egress in a dark, smoke-filled room or under other emergency conditions, and there is no searching for keys or fumbling with a lock combination. Also a feature of the invention is an electronic alarm which is actuated whenever unlatching takes place without permission.

Yet another object of the invention is to provide a window guard assembly that presents an attractive appearance and affords a high degree of security, yet can be manufactured at relatively low cost.

Briefly stated, these objects are attained in a window guard screen and frame assembly installable on the jamb of a building window to prevent unauthorized access thereto. The screen is fabricated of a metal sheet whose margins are folded in to define channel-like end and side branches bordering a planar field perforated to admit light and air. The frame is dimensioned to overlie or nest within the window jamb and is secured thereto. Integral with the inner surface of the frame and bordering the opening therein is a slideway socket for receiving the screen, the socket being defined by end and side legs which complement the branches of the screen.

Hinge pins are mounted on the end legs of the slideway socket adjacent one side leg, the pins extending through elongated slots formed in the corresponding end branches of the screen whereby the screen is slidable to an extent limited by the slots from a security mode position in which the screen is confined to the socket and the window is guarded, to an access mode position in which the screen is free to swing on the hinge pins out from the frame opening to permit one to exit through the then unguarded window. A releasable latch is mounted on the other side leg of the socket to engage the corresponding side branch of the screen to lock the socketed screen in its security mode position. When released, the latch permits the screen, which is spring loaded, to slide to its access mode position.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Figure 2:
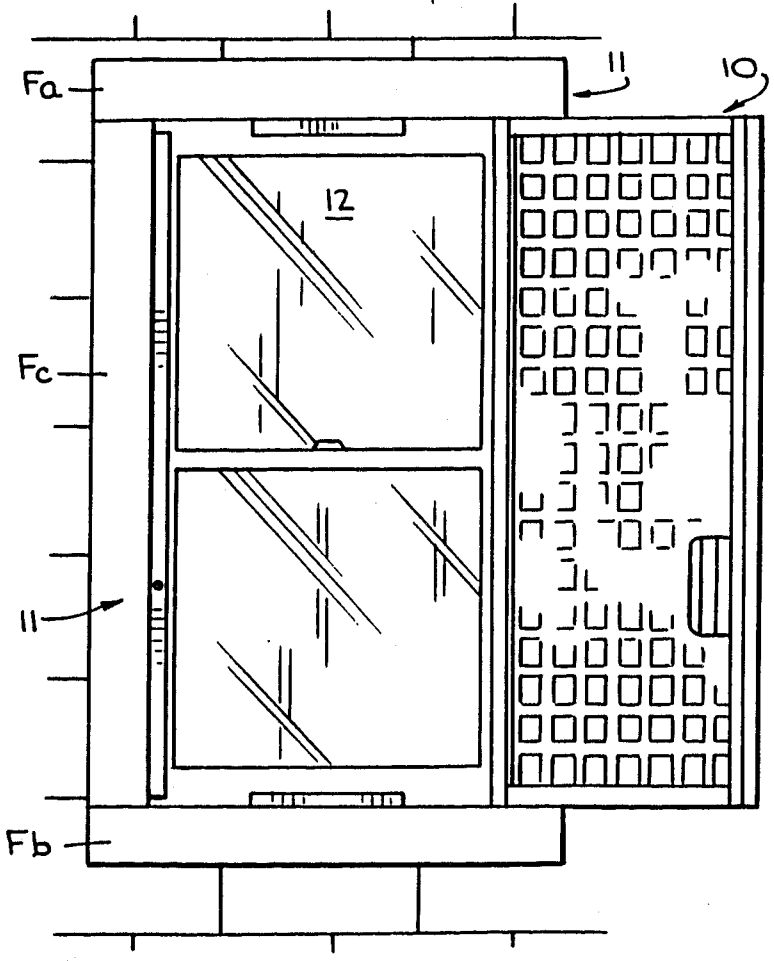
FIG. 2 is the same as FIG. 1, except that in this figure the assembly is shown in its access mode with the screen swung out from the frame of the assembly to permit exit from the building through the then unguarded window.
Figure 1:
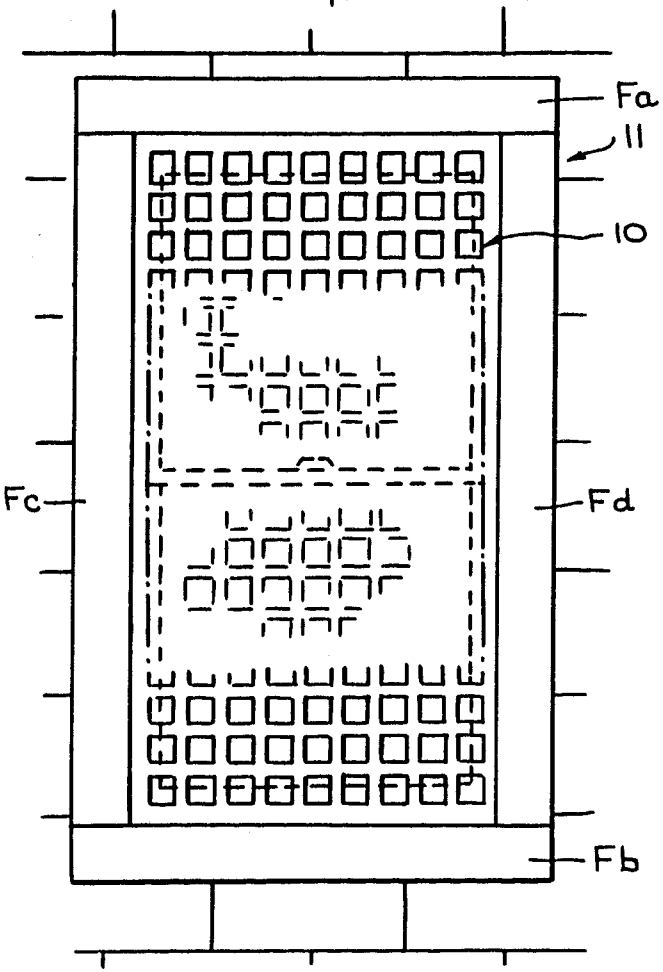
FIG. 1 illustrates in front view a window guard assembly according to the invention installed on the window jamb of a building, the assembly being shown in its security mode to prevent unauthorized access to the building through the guarded window.

It will be seen in FIGS. 1 and 2 that a releasable window guard assembly according to the invention has two main components: a metal screen identified generally by numeral 10, and a planar metal frame identified generally by numeral 11, behind whose rectangular opening the screen normally lies.

There are two modes of operation: a security mode as shown in FIG. 1, in which a window 12 on or in whose jamb the assembly is installed is guarded, and an access mode as shown in FIG. 2 in which the screen is swung open and the window is unguarded. In the security mode, intrusion is prevented, while in the access mode, one may exit from the unguarded window in the event of a fire or other emergency.

In the security mode, screen 10, whose front surface is planar, lies against the rear surface of planar frame 11 and is blocked thereby, so that virtually no gap exists therebetween which would permit an intruder to insert a tool to pry open the screen. As shown in FIGS. 1 and 2, planar frame 11 lies flat against the exterior wall of the building, and since the front surface of the screen is virtually co-planar with the frame, the installed assembly is altogether free of bolts, ridges, or other protrusions, and thereby presents a clean, uncluttered appearance compatible with the architecture of the building. Alternatively, frame 11 may be dimensioned to nest within the window opening and to be flush with the facade of the building.

The screen, which is hinged to the frame, is provided with a latch to maintain it in its security mode. The rectangular opening of the frame has a height that matches that of the screen and a width somewhat smaller than that of the screen, so that it can only be swung out of the opening when angled with respect thereto. It is then possible in the access mode to swing out the screen and to open window 12 and exit therefrom. Also in this mode, one can clean the outside of window 12 and all parts of the assembly.

Figure 3:
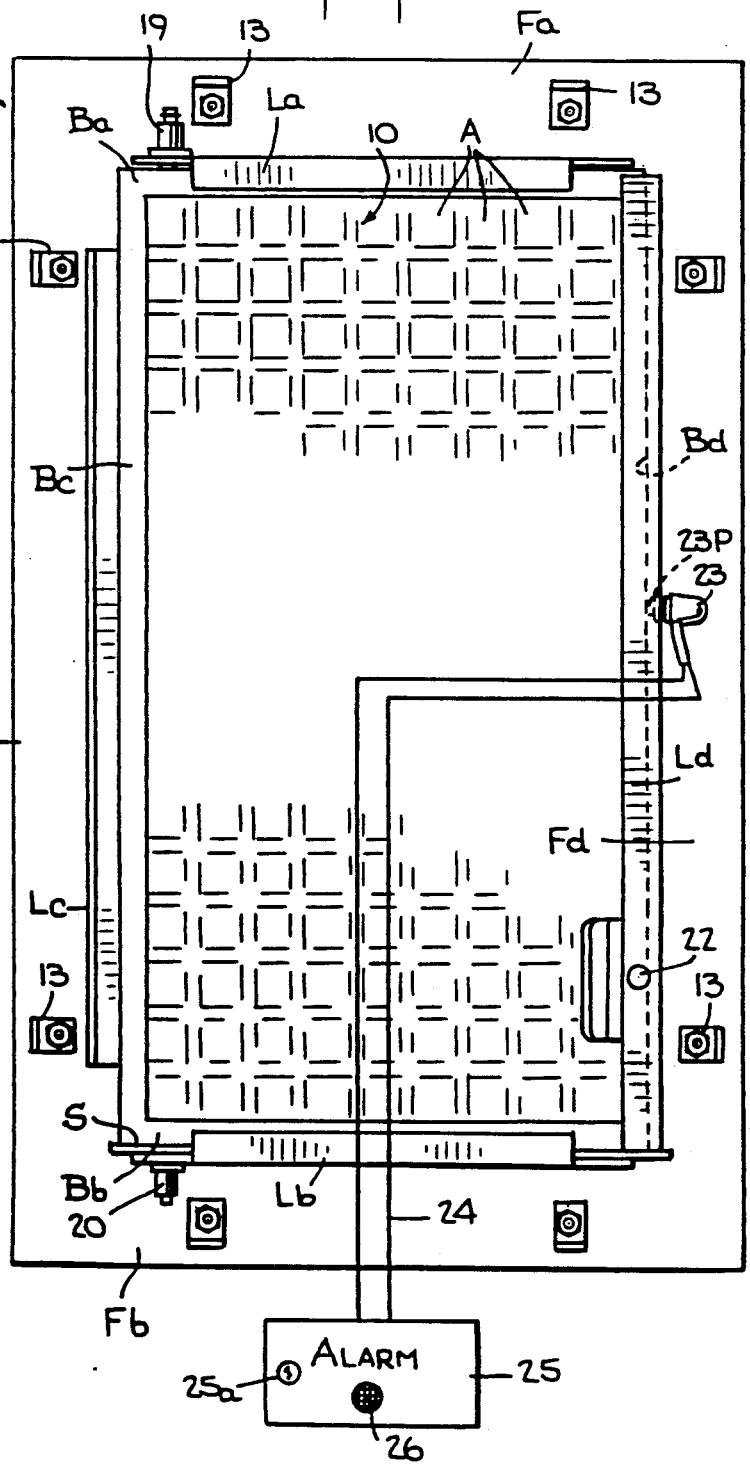
FIG. 3 is a rear elevation view of the assembly.

As shown in FIG. 1, frame 11 is constituted by upper and lower end metal plates Fa and Fb and right and left side plates Fc and Fd which are welded together to form the frame behind whose rectangular opening lies screen 10 which in the security mode lies parallel to frame 11 and is blocked thereby. In practice, instead of separate plates, frame 11, as shown in FIG. 3, may be formed of a single piece of metal, in which case the metal plates that define the rectangular frame are integral with each other. Attached to the inner surface of the frame plates Fa, Fb, Fc and Fd are right-angle or L-shaped brackets 13, a spaced pair of brackets being provided for each plate.

Figures 5, 6:
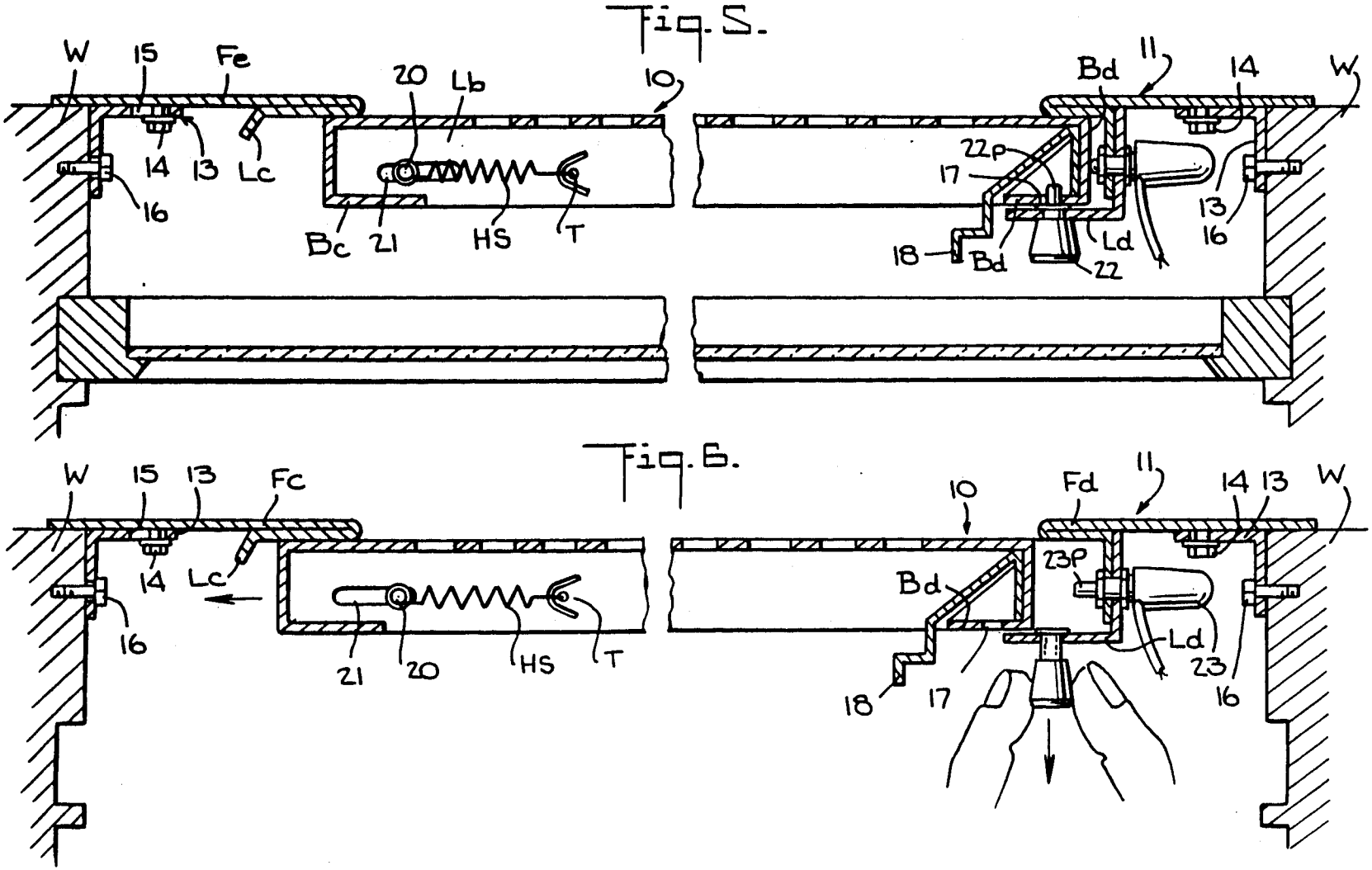
FIG. 5 is a transverse section taken through the installed assembly which is shown in the security mode with the screen latched.
FIG. 6 is the same as FIG. 5, except that the assembly is shown with the screen being unlatched so that it can shift to the access mode.

As shown in FIGS. 5 and 6, brackets 13, which are adjustable, serve to secure the frame to the corresponding end and side walls W of the jamb for window 12. One arm of each bracket is attached to a frame plate by a bolt 14 that passes through an elongated slot 15 in this arm. The other arm of each bracket is secured to jamb wall W by a bolt 16 which passes through a slot in this arm. In practice, depending on the material from which the jamb is fabricated, a suitable anchor may be wedged in a hole drilled in the wall, such as a masonry anchor, to threadably receive the mounting bolt. Because of slot 15, the position of each bracket 13 is adjustable within the slot limits relative to the related frame plate, the bracket offering two adjustment ranges by reason of the slots in the arms thereof.

Typically, though window jambs in a building are nominally identical in their dimensions, they actually vary somewhat from window to window. Also, some of the jambs may be out of square. But because brackets 13 are shiftable relative to the frame pieces, the same assembly may be conformed to jambs that vary somewhat in their dimensions, thereby avoiding the need to custom-tailor the assemblies to the jambs.

As best seen in FIG. 3, which is a rear view of the assembly, and in FIGS. 5 and 6, which are transverse sections of the assembly, screen 10 is fabricated from a single sheet of high strength metal such as steel whose margins are folded in to define channel-shaped branches, each having a U-shaped cross section. The upper and lower end branches of screen 10 are identified as branches Ba and Bb, while the right and left side branches are identified as branches Bc and Bd. These branches may be welded together at the corners of the screen to provide a screen, which even though fabricated of thin metal, is highly resistant to flexure.

The branches border a planar field that is perforated to provide apertures A that admit light and ventilating air. But because the screen is thin, it does not markedly reduce visibility when one looks through the screen at an oblique angle. In contradistinction, in the case of a relatively thick mesh screen formed of woven wire, of expanded metal or similar material, one experiences a sharp loss in visibility, for at an oblique angle, a thick screen tends to block the view.

Perforations A in the planar field of screen 10 are in a predetermined pattern dictated in good part by aesthetic considerations. Thus instead of a uniform pattern of apertures as shown in FIG. 3, the pattern may be such as to define an array of apertures divided into geometric zones by unapertured bands in a criss-cross or grid formation to simulate muntins or produce other decorative effects to enhance the attractiveness of the assembly.

Figures 7, 8, 9, 10:
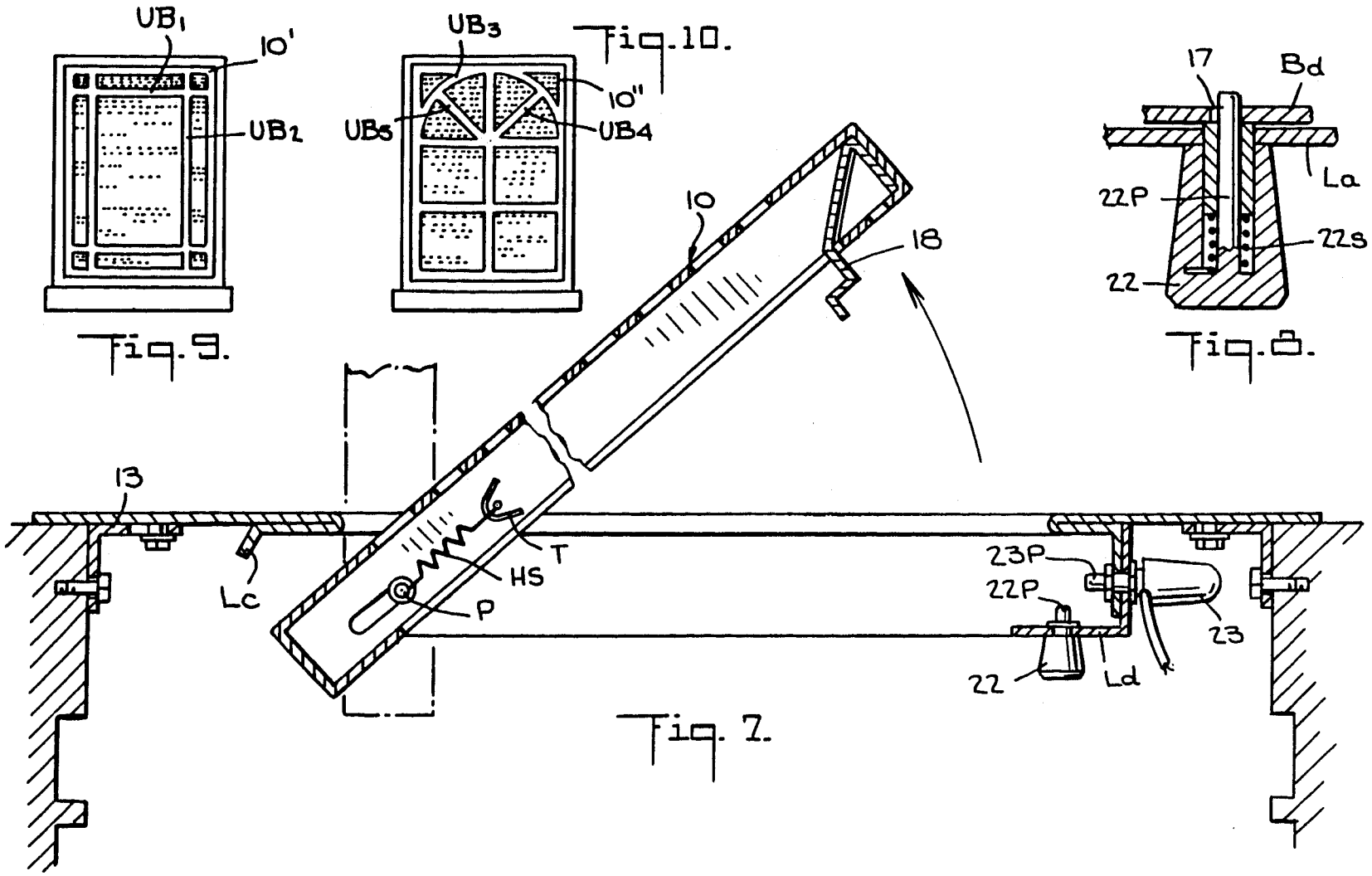
FIG. 7 is the same as FIG. 6 except that the screen of the assembly is unlatched and is swung out from the frame opening so that one may now open the window and exit therefrom.
FIG. 8 is an enlarged sectional view of the latching pin.
FIG. 9 shows one preferred pattern of screen perforations.
FIG. 10 shows another preferred pattern of screen perforations.

Thus as shown in FIG. 9, screen 10′ is provided with a pair of horizontal unapertured bands UB, intersected by a pair of vertical unapertured bands $UB_2$ to create an abstract pattern appropriate to a building whose architecture has a modern motif. In the pattern formed in security screen 10″ shown in FIG. 10, an arch effect is created by the unapertured arcuate band $UB_3$ in combination with the radial bands $UB_4$ and $UB_5$. This is appropriate for more traditional architecture.

Screen 10, as best seen in FIGS. 3, 5 and 6, is received within a slideway socket formed on the rear of frame 11. The socket is defined by upper and lower end legs La and Lb, and right and left side legs Lc and Ld welded to or integrated with the corresponding frame plates Fa to Fd. Upper end leg La, as best seen in FIG. 3, is provided with a turned-in flange, and lower leg Lb is provided with a similar flange.

These flanges act as a barrier to prevent screen 10 which is hinged to the socket and is slidable therein, from swinging inwardly, the screen being permitted only to swing outwardly through the frame opening. Alternatively, these fixtures can be reversed for interior installation, so that the screen is then adapted to open inwardly, not outwardly. Where, for example, the purpose of the window guard assembly is detention, not security, a guard assembly having a security screen which pivots inwardly and is released from the exterior is then useful for this purpose. As shown in FIG. 3, screen 10, which is slidable, rests on a strip S which is formed of a low-friction material such as TEFLON (PTFE) to facilitate sliding motion.

Right side leg Lc of the socket is flangeless, whereas left side leg Ld is channel-shaped to accommodate the correspondingly-shaped side branch Bd of screen 10. As shown in FIGS. 5 and 6, mounted on left side leg Ld of the socket is a releasable latch 22 whose pin 22*p* enters a latch hole 17 in the corresponding side branch Bd of the screen to prevent sliding movement of the screen in the security mode of the assembly, this being shown in FIG. 5. It will be noted in FIG. 8 that pin 22*p* is spring loaded by a helical spring 22*s*.

When, as shown in FIG. 6, latch pin 22*p* is retracted from hole 17, screen 10 is then free to slide toward right side leg Lc of the socket so that the side branch Bd of the screen is no longer confined in the corresponding side leg Ld of the socket. This represents the access mode of the assembly in which the screen can now be angled and swung out of the rectangular opening of the frame.

Attached to the left side branch Bd of the screen at a position adjacent latch 22 in side leg Ld is a shaped metal shield 18. This acts as a barrier to prevent an intruder outside the building from inserting a tool through the apertured screen to engage and release the latch. An extension of the shield acts as a handle to facilitate sliding of the screen in the socket. Preferably, the handle/shield is made from stainless steel and incorporates a 45 degree bend to deflect drill bits inserted by an intruder through apertures in the screen.

Figure 4:
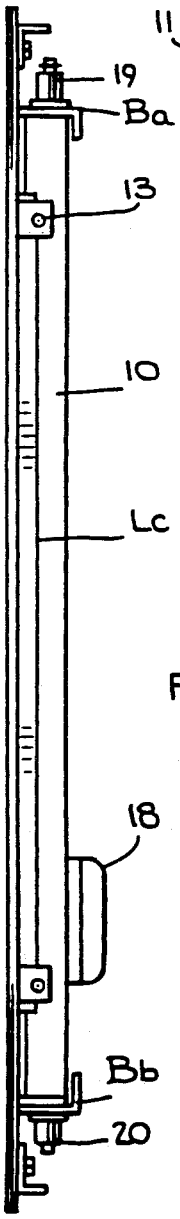
FIG. 4 is an end view of the assembly.

As shown in FIGS. 3 and 4, screen 10 is hinged at one end of its end branches Ba and Bb to the upper and lower legs La and Lb of the frame socket by hinges having hinge pins 19 and 20. These hinge pins pass through an elongated slot 21 in each of these legs. Thus when the screen is made to slide in the slideway socket, the hinge pins borne by the screen slide in slots 21 which limit the extent of slide.

FIG. 5 shows hinge pin 20 which extends through slot 21 adjacent one end of the slot in the security mode of the assembly. FIG. 6 shows hinge pin 20 adjacent the other end of slot 21 in the access mode in which mode screen 10 can now be angled with respect to the frame and swung out.

A helical metal assist spring HS is stretched between a selected struck-out tab T in a row thereof on the lower end of leg Lb of the screen and hinge pin 20, the selection determining spring tension. The spring is hooked at its ends onto the selected tab and the hinge pin and serves to assist the screen to slide to its access mode position when the screen is unlatched. But when the screen is to be shifted to its security mode position, it is done so manually against the tension of the spring.

Hinge pins 19 and 20 are retractable from their hinges, so that should one wish to separate the screen from the frame for purposes of maintenance and repair, this can be done without difficulty by unhooking the spring and then removing the hinge pins from their hinges.

When in the access mode, screen 10 is swung out of the frame opening, one can then exit from the building through window 12. The assembly is rattle-free in the security mode, side branch Bd of the screen being nested within leg Ld of the frame socket.

It is a simple matter to unlatch the screen, for all that is necessary is to pull out latch 22. Yet though simple, the latch is highly effective, for by pulling out the latch, one is not yet able to then swing out the screen, for to do so, the screen must slide to disengage its side branch Bd from the side leg Ld of the socket.

A narrow space between the screen and the upper and lower legs of the retaining socket within which the screen is slidable is unavoidable. As a consequence, the hinge pins coupling these legs with the upper and lower branches of the socket extend through this space. It would be possible with an appropriate tool for an intruder to insert this tool into this narrow space and saw through the hinge pins. But the screen in its security mode position is latched, even if the hinge pins were cut, it would still be impossible to remove the screen from its confining socket, for to do so, one must first slide the screen, and this cannot be done without first releasing the latch which is not accessible to the intruder.

In practice, in addition to a hole in one of the side legs of the socket and a hole in the corresponding branch of the screen to accommodate the latch mechanism, one may provide at least one secondary set of holes to accommodate a padlock or other secondary lock mechanism, where such is desirable for high security purposes. But in school buildings and in similar installations, to discourage students from opening the screen, thereby compromising safety, a plastic tamper seal may be provided that goes through the secondary set of holes, but which can be pulled off when necessary.

Instead of a "pull" type latch mechanism, this mechanism can be of the "push" type or of the side-operating type. Because of the branched character of the screen, its channels may be used to accommodate a Lexan window to render it bullet proof, or a storm window, or even insect screening.

In practice, the entire unit can be so oriented on installation as to permit the hinged screen to open either to the right or left, or up or down. After this choice is made, the latch and handle are installed at the site at appropriate positions, multiple holes being provided in the unit to accommodate this choice.

The apertures in the screen may be rectangular, circular or in any other geometric or free-form shape, provided that the interstitial webs retain adequate substance and strength to afford the desired degree of security, and that the apertures are small enough to obstruct the entry of implements seeking to compromise or operate the egress mechanism.

Under normal circumstances, the only occasion one has to open the window from the interior of a room and then unlatch the screen and swing it out so that one can exit from the building through the window, is when an emergency arises, as a fire within the building. But when the guard assembly is installed, say, in a public school building where students as well as staff are instructed never to unlatch the guard screen except in an emergency when it becomes necessary to open the window, these instructions may not be obeyed by all of the building occupants.

The nature of the latch mechanism is such that one has only to pull out the latch knob to release the latch. This is highly desirable, for in an emergency it is important to be able to unlatch the screen without difficulty. But because it is simple to unlatch the screen, students may be tempted as a prank to do so, in which case this breach of security may go undetected. And while the window is then unguarded, there may be no outward evidence of the fact unless the screen is swung out of the frame.

In order to provide an alarm signal in the event the guard assembly is improperly unlatched, the assembly, as shown in FIGS. 3, 5, 6 and 9, is provided with an electrical switch 23 mounted on leg Ld of the slideway socket. The switch includes a depressible actuator pin 23*p* which when the pin is depressed, acts to close the switch, which is opened only when the pin is extended. The actuator pin 23*p* is engaged by branch Bd of screen 10 when the screen is in the security mode, as shown in FIG. 5. But when the screen is unlatched, as shown in FIG. 6, and the screen slides away from leg Ld, the actuator pin then resumes its extended position, causing electrical switch 23 to open.

As shown in FIG. 3, switch 23 is connected by wires 24 to a self-sufficient electronic alarm box 25, which in practice may be located at a suitable site within the room or elsewhere where its signal can be heard by those in authority. In practice, box 25 may be provided with a jack to receive the plug of a line connecting the box to a central alarm system.

Alarm 24 is enabled by a key inserted in a keyhole 26. The alarm includes a battery-operated oscillator which produces a siren-like audio signal which is applied to a miniature loudspeaker 26, but only when the enabled or armed alarm responds to the opening of switch 23.

Hence after the window guard assembly is latched to secure the window protected by the installed assembly, alarm 25 is then enabled by inserting and turning a key in keyhole 26. Then if the assembly is unlatched by someone in the room, the alarm will immediately go off.

While the alarm is intended primarily to call attention to an unauthorized unlatching of the assembly by an individual in the room, should an outside intruder somehow succeed, as by blow torching an opening through the screen, in obtaining access to the latch, the alarm will sound off when the screen is unlatched.

In practice, it is not necessary to have a separate alarm box for each window, for the alarm switches in each window assembly may be wired to a common box, and if any of these switches is caused to open as a result of an unauthorized unlatching of any one of the assemblies, the alarm will be activated.

In practice, the frame of the window guard assembly may be fabricated of stainless steel or of extruded aluminum parts, the latter simplifying the production process and reducing fabrication costs.

While there has been shown and described a preferred embodiment of a releasable window guard assembly in accordance with the invention, it will be appreciated that many changes and modifications may be made therein without, however, departing from the essential spirit thereof. Thus while the assembly has been shown as a window guard, in practice it may be dimensioned to function as a door guard or as a guard for any other type of opening.

We claim:

1. a releasable screen and frame assembly mountable on the jamb of a window to prevent an intruder from gaining access to a building through the window, the screen when unlatched permitting exit from the building through the window, the assembly comprising:

(a) a rectangular screen fabricated from a single sheet of metal whose margins define end branches and side branches which border a planar field;

(b) a metal frame dimensioned to overlie or nest within the jamb of the window and being attachable to the jamb, said frame defining a rectangular opening whose height matches that of the screen and whose width is smaller than that of the screen whereby the screen can only swing out from the opening when the rectangular screen assumes an angle with respect thereto;

(c) a slideway socket including end and side legs formed on the rear surface of the frame and surrounding the opening to accommodate the screen; and (d) hinges mounted on the end legs of the socket adjacent one end thereof and having pins extending through slots in corresponding end branches of the screen, whereby the screen is slidable in the socket from a security mode position wherein it lies parallel to the frame and is blocked thereby to guard the window, to an access mode position in which the hinged screen can be caused to assume an angle with respect to the opening and swung out therefrom to permit exit through the window.

2. An assembly as set forth in claim 1, wherein the planar field of the screen is perforated in a predetermined manner to admit light and air.

3. An assembly as set forth in claim 2, wherein said pattern is such as to include unperforated bands on the field simulating linear or curved geometric patterns.

4. An assembly as set forth in claim 1, further including a latch mounted on one of the side legs of the socket and provided with a retractable latch pin which in the security mode enters a latch hole in the corresponding side branch of the screen, the screen being unlatched when the latch pin is retracted.

5. An assembly as set forth in claim 4, further including a spring stretched between a point on one of the side branches of the screen and the hinge pin extending through the slot on this side branch whereby when the screen is unlatched, the spring then acts to slide the screen to its access mode position.

6. An assembly as set forth in claim 4, further including a shield mounted on said corresponding side branch of the screen adjacent the latch hole therein and angled with respect to this side branch.

7. An assembly as set forth in claim 6, wherein the shield is provided with a handle extension.

8. An assembly as set forth in claim 1, wherein said hinge pins are retractable from the hinges to permit separation of the screen from the frame for purposes of maintenance.

9. An assembly as set forth in claim 1, further including an electrical switch mounted on one of the side legs of the socket and provided with an actuator pin that is engaged by the corresponding side branch of the screen only when the screen is in its security mode, the actuator pin when so engaged acting to close the switch, and an electronic alarm coupled to the switch which is activated when the screen is in its access mode and the actuator pin is then disengaged, causing the switch to open.

10. An assembly as set forth in claim 9, wherein said electronic alarm is key-operated and is enabled only when a key is turned, said alarm being self-contained and including a loudspeaker to which an audio alarm signal is applied when the alarm is enabled and the alarm switch is opened.

* * * * *